United States Patent [19]

Moore

[11] Patent Number: 4,779,794

[45] Date of Patent: Oct. 25, 1988

[54] SPHERICAL LAUNDRY BASKET

[76] Inventor: Gail S. Moore, Crescent Village #409, Clifton Park, N.Y. 12065

[21] Appl. No.: 120,236

[22] Filed: Oct. 30, 1987

Related U.S. Application Data

[63] Continuation-in-part of Ser. No. 797,398, Dec. 23, 1985, abandoned.

[51] Int. Cl.[4] ..... B65D 85/18

[52] U.S. Cl. ..... 232/1 B; 150/48; 217/122

[58] Field of Search ..... 232/1 B; 217/122, 124, 217/125; 206/315.9; 150/48, 50, 51

[56] References Cited

U.S. PATENT DOCUMENTS

| | | | |
|---|---|---|---|
| 2,899,103 | 8/1959 | Ebert | 150/48 X |
| 2,945,582 | 7/1960 | Abraham et al. | 150/48 X |
| 3,080,951 | 3/1963 | Kaufman | 206/315.9 |
| 3,136,398 | 6/1964 | Platt | 206/315.9 |
| 4,602,719 | 7/1986 | Borst | 220/339 X |

*Primary Examiner*—Robert P. Swiatek
*Attorney, Agent, or Firm*—Heslin & Rothenberg

[57] ABSTRACT

A spherical shaped laundry basket which is designed to be pulled by a side strap is disclosed. There is a compartment contained within the bottom portion of the basket for the purpose of transporting laundry related products. The laundry basket is manufactured of plastic and includes an upper, open weave pattern and a lower solid section.

4 Claims, 1 Drawing Sheet

SPHERICAL LAUNDRY BASKET

This application is a continuation in part of application Ser. No. 797,398 filed 12/23/85 now abandoned.

FIELD OF THE INVENTION

This invention relates to containers, and more particularly, to plastic laundry baskets. The invention differs from laundry baskets presently on the market because of its spherical shape and the fact that it is pulled by a strap rather than carried by handles.

BACKGROUND ART

It is the object of this invention to make it easier for people who live in apartment complexes to do their laundry, whether on the apartment premises or at a laundromat. This object is accomplished, as noted above, by providing a spherically-shaped laundry basket which is designed to be pulled rather than lifted, as is the case with a typical laundry basket. Further, because of its spherical shape, the basket can be pulled up and down stairs as easily as it can be pulled along a floor. Also, the basket's pull strap is helpful to mothers with toddlers because the mother can hold the child in one hand and with the other hand pull her laundry basket. Additionally, the basket is clearly beneficial to people with back problems since pulling is less strenuous than lifting.

SUMMARY OF THE INVENTION

A plastic, spherical-shaped laundry basket is provided having a bottom hemispherical portion and a top hemispherical portion hingedly secured together. The bottom and top portions each have a flange which contact each other in abutting relation when the bottom portion and the top portion are closed together such that the basket has said spherical shape. The top portion is constructed of an open weave pattern, and the bottom portion is constructed with an upper section of open weave pattern and a lower, substantially solid walled section. Securing means are provided for fastening the top and bottom portions together when in a closed position and a strap is secured to either the top or the bottom portion to facilitate pulling of the basket along a floor or stairs.

BRIEF DESCRIPTION OF THE DRAWINGS

While the specification concludes with claims particularly pointing out and distinctly claiming the present invention, the objects, features, and advantages of the present invention can be more readily ascertained from the following detailed description of one preferred embodiment when read in conjunction with the accompanying drawings in which:

DESCRIPTION OF A PREFERRED EMBODIMENT

Figure 1:
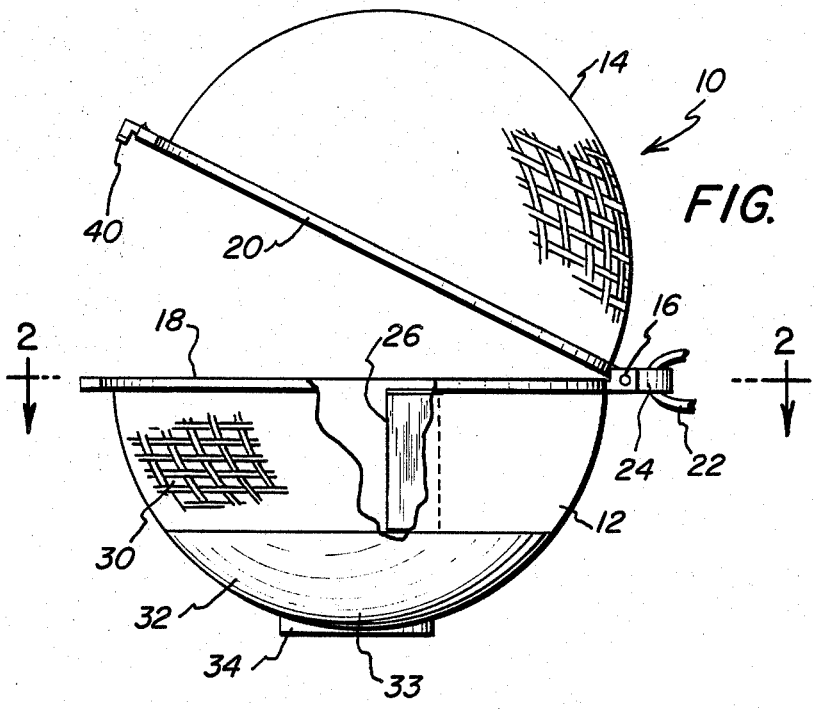
FIG. 1 is a side elevational view of the spherical laundry basket of the present invention.
Figure 2:
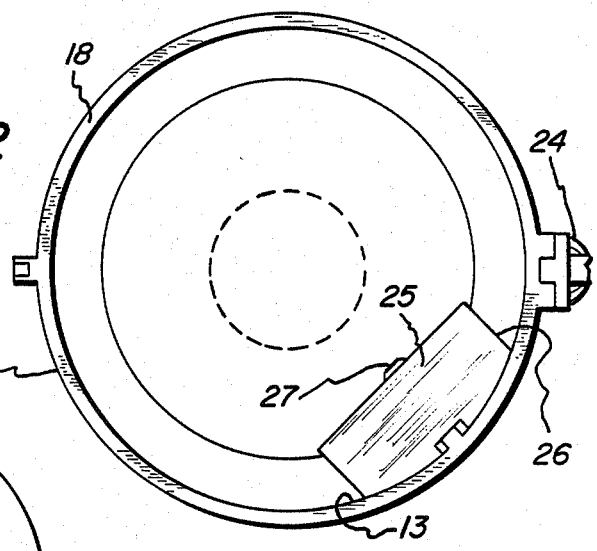
FIG. 2 is a top plan view of the bottom portion of the basket shown in FIG. 1.
Figure 3:
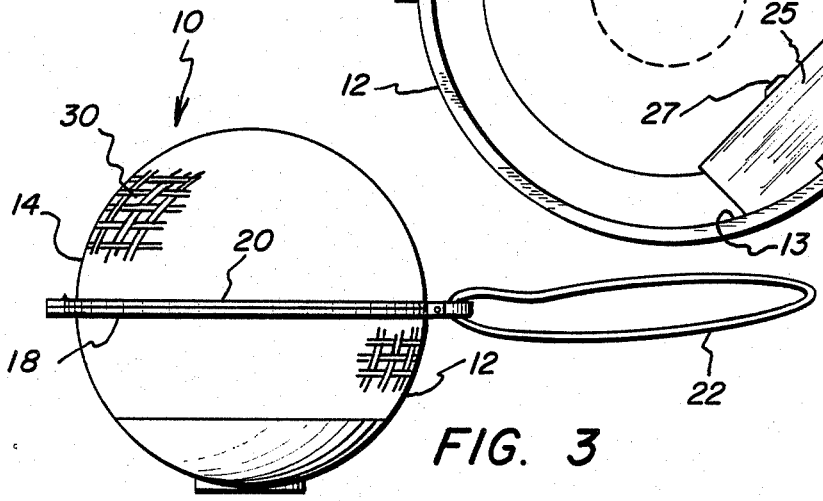
FIG. 3 is a perspective view of the basket shown in FIG. 1.

Referring to FIGS. 1, 2 & 3, the spherical shaped laundry basket of the present invention, generally denoted 10, is shown. Basket 10 includes a bottom hemispherical portion 12 and a top hemispherical portion 14 which are hinged 16 together. Bottom portion 12 and top portion 14 each have a periphery or flange 18 & 20, respectively. Flanges 18 & 20 meet in abutting relation when top portion 14 and bottom portion 12 are closed together as shown in FIG. 3. Top and bottom portion 14 & 12, respectively, are secured together in a closed position via a slide latch 40. A strap 22 is secured by any standard means, e.g. fed through a plastic loop 24 affixed to basket 10. Located within the bottom portion 12 of basket 10 is a compartment 26 for storing miscellaneous laundry products.

Basket 10 is made from a plastic material selected from the group consisting of polypropylene and polyethylene (a durable/flexible plastic).

Bottom portion 12 of basket 10 includes an upper section 30 of open weave pattern, a lower, solid walled section 32, to prevent dirt and particles from entering the basket as it is pulled, and a bottom, reinforcement member 34 manufactured of a thicker plastic, at its base 33. Top portion 14 is also preferably constructed of an open weave pattern.

As noted above, bottom portion 12 includes an inner compartment 26 capable of holding various laundry products, e.g., detergent, softener, bleach, etc. Compartment 26, made of a solid plastic, is attached to the inner side wall 13 of bottom portion 12. A lid 25 is attached to compartment 26 and is capable of being secured thereto in a closed position by a tongue latch 27.

The strap is a continuous loop of, for example, 72 inches in length. The strap can be made from either a plastic or a cloth material.

It is understood that the invention is not confined to the particular construction and arrangement herein and illustrated and described but embraces such modified forms thereof as come within the scope of the following claims.

I claim:

1. A spherical-shaped laundry basket, comprising:

a bottom hemispherical portion and a top hemispherical portion hingedly secured together, said bottom portion and said top portion each having a flange, said bottom portion flange and said top portion flange contacting each other in abutting relation when said bottom portion and said top portion are in a closed position;

said top hemispherical portion having an open weave pattern, said bottom hemispherical portion having an upper section of open weave pattern and a lower, substantially solid walled section;

means for securing said top hemispherical portion and said bottom hemispherical portion together when said top portion flange and said bottom portion flange are in abutting relation;

a strap secured to one of said bottom hemispherical portion and said top hemispherical portion to facilitate pulling of said basket, whereby said basket may be used to transport laundry from one location to another without lifting thereof, the rounded wall of the bottom hemispherical portion and the top hemispherical portion facilitating pulling of the basket.

2. The invention of claim 1, wherein said basket is manufactured of plastic.

3. The invention of claim 2, wherein said bottom hemispherical portion includes a separate, closable compartment for carrying miscellaneous laundry products.

4. The invention of claim 1, wherein said bottom hemispherical portion includes a reinforcing member at its base.

* * * * *